US010085497B2

(12) United States Patent
Douglas et al.

(10) Patent No.: US 10,085,497 B2
(45) Date of Patent: Oct. 2, 2018

(54) METHODS AND ARTICLES FOR ACCESSORIZING SHOULDER, CHEST, AND BACK

(76) Inventors: Treba Douglas, Atlanta, GA (US); LaRisa Hutton, Atlanta, GA (US)

( * ) Notice: Subject to any disclaimer, the term of this patent is extended or adjusted under 35 U.S.C. 154(b) by 1106 days.

(21) Appl. No.: 13/477,031

(22) Filed: May 21, 2012

(65) Prior Publication Data

US 2012/0291176 A1 Nov. 22, 2012

Related U.S. Application Data

(60) Provisional application No. 61/519,247, filed on May 19, 2011.

(51) Int. Cl.

| | |
|---|---|
| ***A41D 15/00*** | (2006.01) |
| ***A41D 27/26*** | (2006.01) |
| ***A41D 1/00*** | (2018.01) |

(52) U.S. Cl.

CPC ..... *A41D 15/007* (2013.01); *A41D 1/00* (2013.01); *A41D 15/005* (2013.01); *A41D 27/26* (2013.01)

(58) Field of Classification Search

CPC ..... A41D 23/00; A41D 27/26; A41D 3/08; A41D 15/005; A41D 13/0512; A41D 2023/002; A41D 2023/004; A42B 1/004; A42B 1/006; A42B 5/00; A47G 9/064; A47G 9/066

USPC ..... 2/207, 91

See application file for complete search history.

(56) References Cited

U.S. PATENT DOCUMENTS

| | | | | | |
|---|---|---|---|---|---|
| 885,872 | A | * | 4/1908 | Scott | 2/91 |
| 1,652,982 | A | * | 12/1927 | Grean | A41D 23/00 2/91 |
| 2,698,942 | A | * | 1/1955 | Neumann | 2/91 |
| 2,727,239 | A | * | 12/1955 | Simon | A41B 13/10 2/49.2 |
| 2,804,626 | A | * | 9/1957 | Rossiter | 2/91 |
| 3,605,121 | A | * | 9/1971 | Suzuki | 2/207 |

(Continued)

FOREIGN PATENT DOCUMENTS

| | | | | |
|---|---|---|---|---|
| FR | 1564917 | A | * | 4/1969 |
| GB | 442684 | A | * | 2/1936 |

OTHER PUBLICATIONS

Density and Specific Gravity (p. 3-13). "Man Made Fibers and Their Properties". URL: infohouse.p2ric.org/ref/12/11471.pdf (site accessed Oct. 5, 2016).*

*Primary Examiner* — Jameson Collier

(74) *Attorney, Agent, or Firm* — Incorporating Innovation LLC; Charlena Thorpe, Esq.

(57) ABSTRACT

Methods and articles for accessorizing a person's shoulder, chest, and back are provided. The methods and articles for accessorizing a person's shoulder, chest, and back of this disclosure provide a defined form or shape so that a consistent, predictable, and repeatable look can be achieved. Furthermore, the methods and articles for accessorizing a person's shoulder, chest, and back of this disclosure can be more difficult to move or slip from their intended placement or become re-arranged from their intended configurations than existing accessory articles such as shawls and scarves. Still further, the methods and articles for accessorizing a person's shoulder, chest, and back of this disclosure are reversible and designed to be transformed into a variety of looks.

11 Claims, 8 Drawing Sheets

(56) References Cited

U.S. PATENT DOCUMENTS

| | | | | | |
|---|---|---|---|---|---|
| 3,798,674 | A * | 3/1974 | Daniel | A45D 44/08 | 2/50 |
| 4,037,340 | A * | 7/1977 | Owensmith | 40/586 | |
| 4,404,688 | A * | 9/1983 | Knight | A41D 23/00 | 2/203 |
| 4,752,971 | A * | 6/1988 | Meserol | A41D 3/08 | 2/84 |
| 4,788,722 | A * | 12/1988 | Oliver | 2/207 | |
| 4,870,707 | A * | 10/1989 | Hayes | 2/207 | |
| 4,942,627 | A * | 7/1990 | Copprue | A41D 23/00 | 2/207 |
| 5,016,288 | A * | 5/1991 | Pan | 2/207 | |
| 5,068,924 | A * | 12/1991 | Ross | A41D 27/26 | 2/268 |
| 5,086,629 | A * | 2/1992 | Dibrell | 62/259.3 | |
| 5,513,392 | A * | 5/1996 | Douglas et al. | 2/207 | |
| 6,226,799 | B1 * | 5/2001 | Lane | 2/207 | |
| 6,450,126 | B1 * | 9/2002 | Schellenbach | A01K 1/029 | 119/531 |
| D487,952 | S * | 4/2004 | Wyatt | D2/500 | |
| 6,868,554 | B1 * | 3/2005 | Melvin | A45D 44/08 | 2/49.4 |
| 7,131,466 | B2 * | 11/2006 | Speich et al. | 139/420 A | |
| 2005/0039242 | A1 * | 2/2005 | Edmondson | 2/207 | |
| 2005/0076419 | A1 * | 4/2005 | Skillman | 2/207 | |
| 2011/0126340 | A1 * | 6/2011 | Wu | 2/88 | |

* cited by examiner

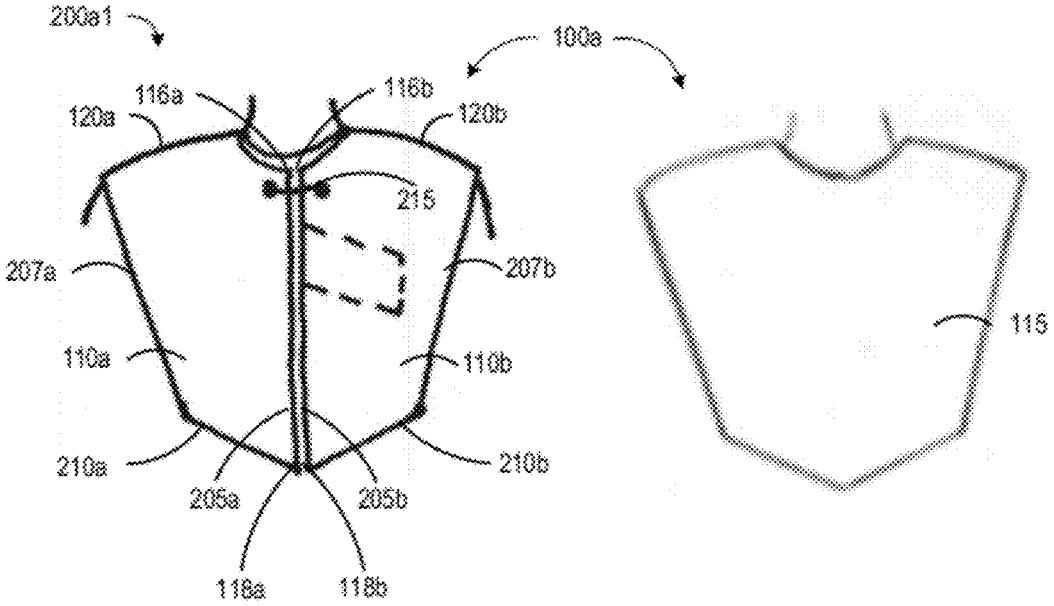
FIG. 2A1
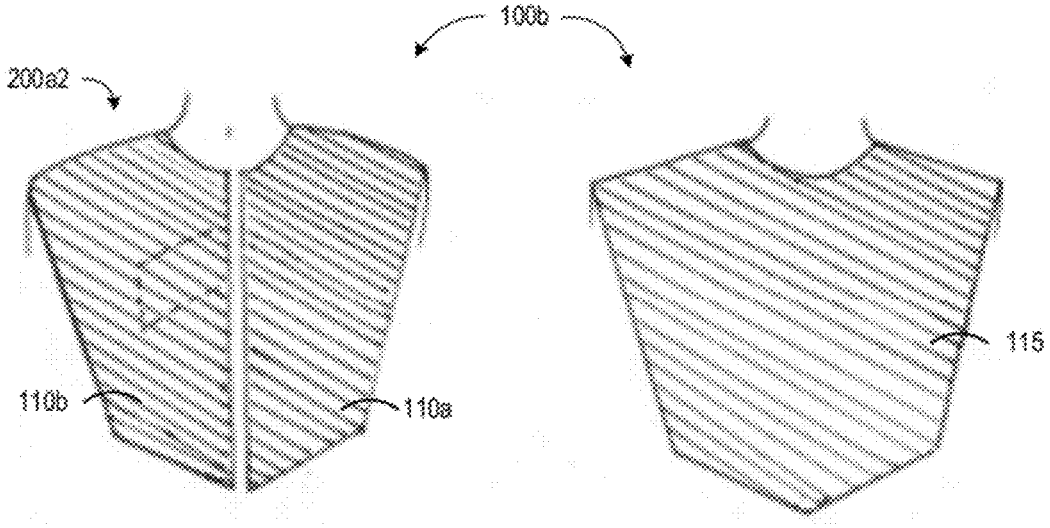
FIG. 2A2

METHODS AND ARTICLES FOR ACCESSORIZING SHOULDER, CHEST, AND BACK

CROSS REFERENCE TO RELATED APPLICATION

This application claims the benefit of U.S. Provisional Application Ser. No. 61/519,247, which was filed on May 19, 2011, and is incorporated herein by reference in its entirety.

TECHNICAL FIELD

This disclosure relates to methods and articles for accessorizing a person's shoulder, chest, and back.

BACKGROUND

Existing accessory articles such as shawls and scarves generally offers no defined form or shape. That is, these articles are designed to amorphously drape the user and thus can have inconsistent, unpredictable, or unrepeatable looks each time the user wears the article. A user may spend a relatively long time attempting to recreate a previous look of these articles. Furthermore, because these articles are made of a lightweight material such as silk, they easily can move or slip from their intended placement or become re-arranged from their intended configurations. Still further, these articles typically are not reversible to offer a different look depending on the side exposed. Even if these articles were reversible, because of the lack of form and shape of these articles, it is difficult to maintain or recreate an intended look for these articles.

Although other articles such as boleros and capes may provide more form and shape than shawls and scarves, these articles are limited in their use. They typically are not reversible and are not designed to be transformed into a variety of looks by manipulating the fabric.

There exists no article for accessorizing a person's shoulder, chest, and back that can be consistently and predictably transformed into a variety of looks so that the intended looks can be easily recreated and maintained.

BRIEF DESCRIPTION OF THE DRAWINGS

FIGS. 2A through 2H illustrate various methods for creating different looks for the article of FIG. 1.

DETAILED DESCRIPTION

Various implementations of this disclosure provide methods and articles for accessorizing a person's shoulder, chest, and back. The methods and articles for accessorizing a person's shoulder, chest, and back of this disclosure provide a defined form or shape so that a consistent, predictable, and repeatable look can be achieved. Furthermore, the methods and articles for accessorizing a person's shoulder, chest, and back of this disclosure may be more difficult to move or slip from their intended placement or become re-arranged from their intended configurations than existing accessory articles such as shawls and scarves. Still further, the methods and articles for accessorizing a person's shoulder, chest, and back of this disclosure are reversible and designed to be transformed into a variety of looks.

Figure 1:
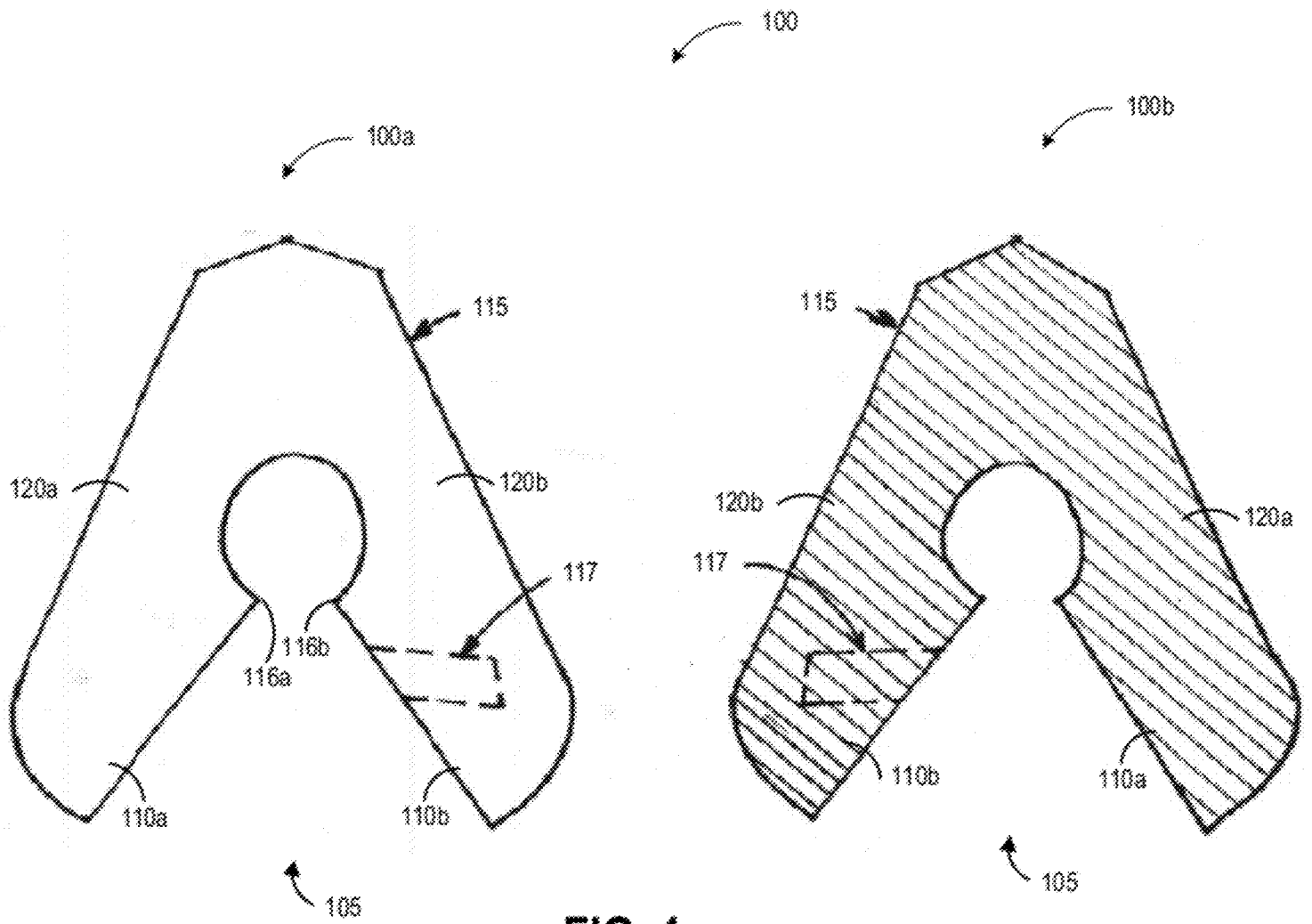
FIG. 1 illustrates an example article for accessorizing a person's shoulder, chest, and back.
Figure 3:
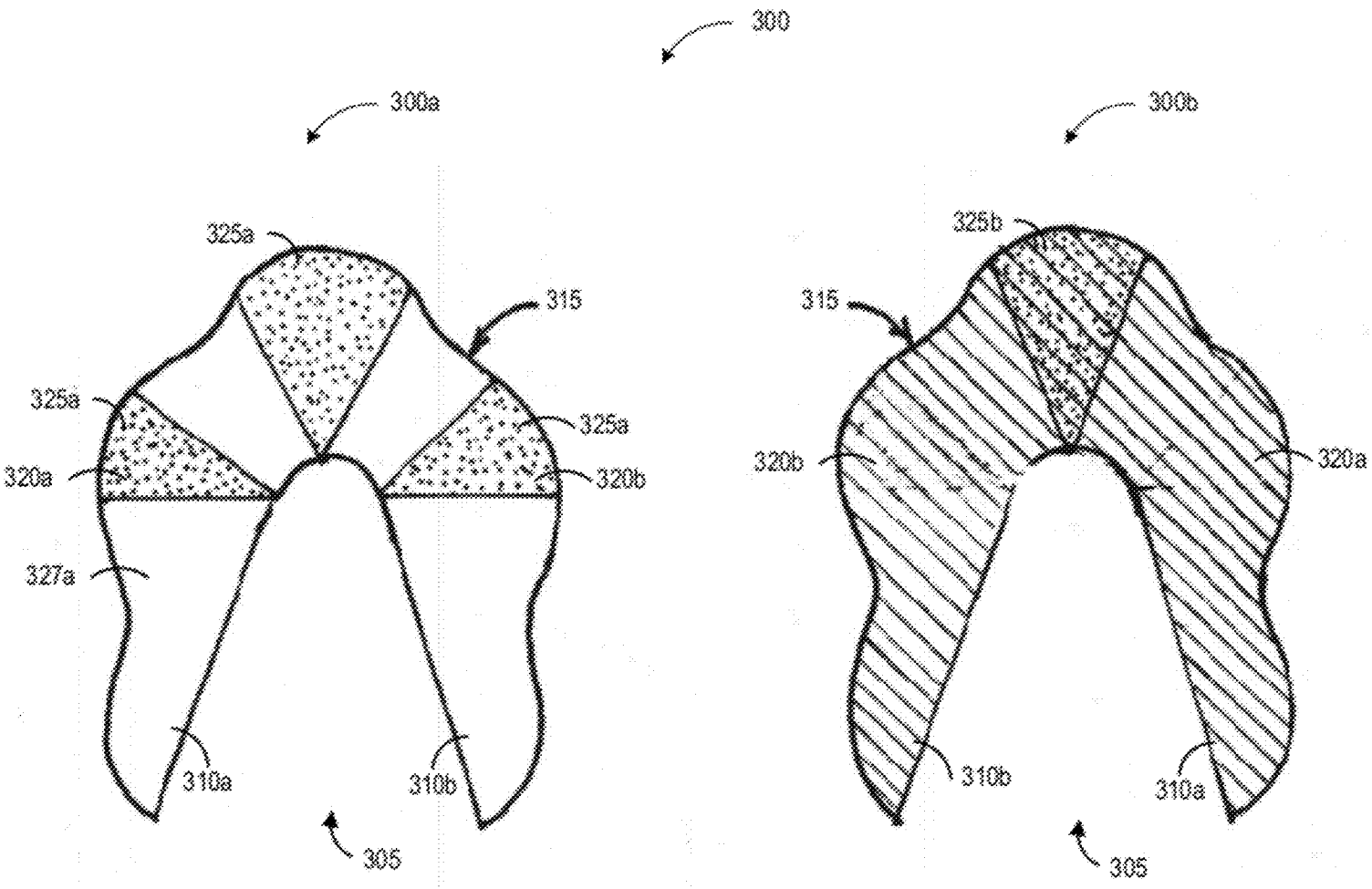
FIG. 3 illustrates another example article for accessorizing a person's shoulder, chest, and back.
Figure 5:
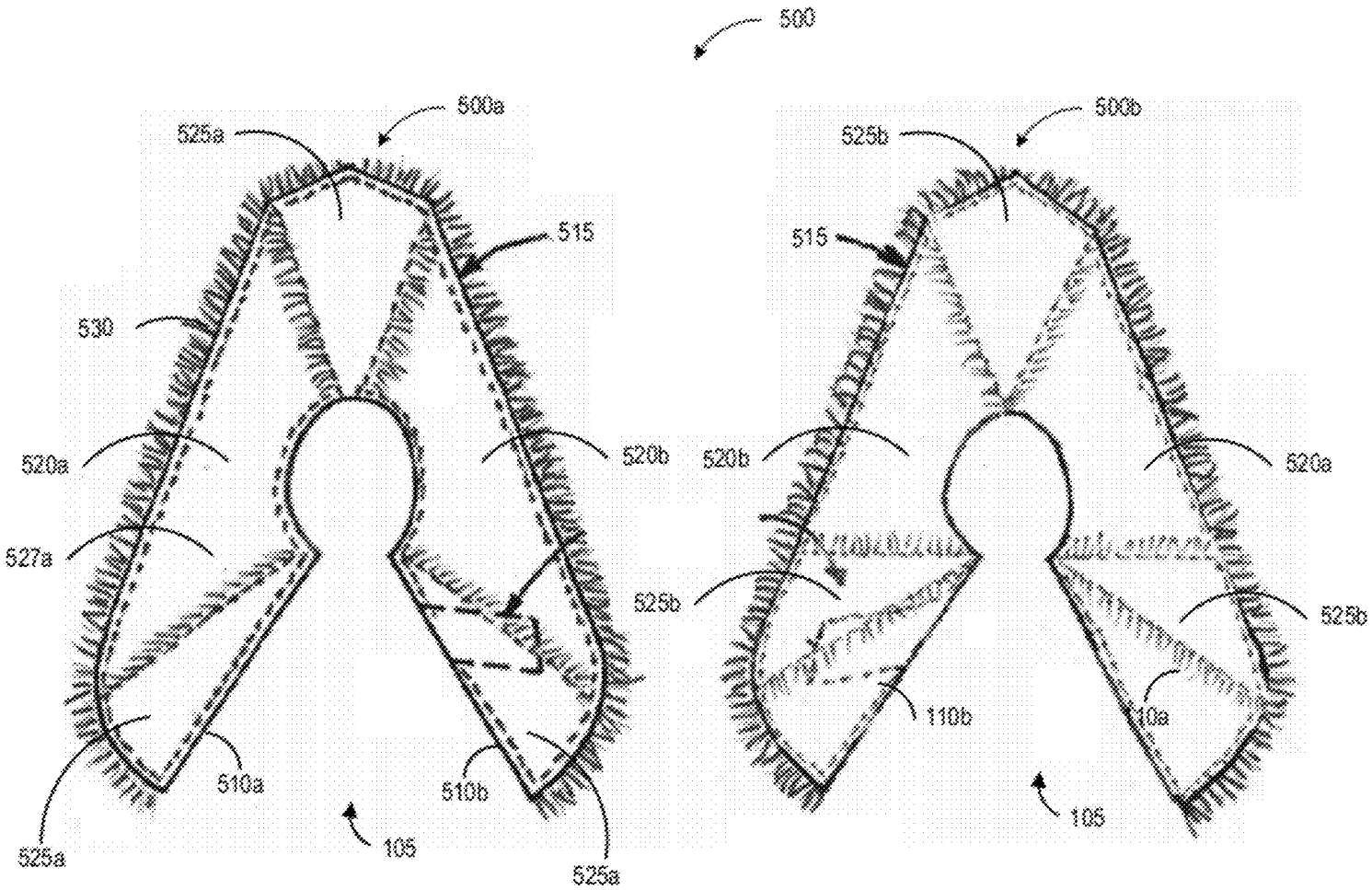
FIG. 5 illustrates the example article of FIG. 1 having decorative inserts and other adornments for accessorizing a person's shoulder, chest, and back.
Figure 6A:
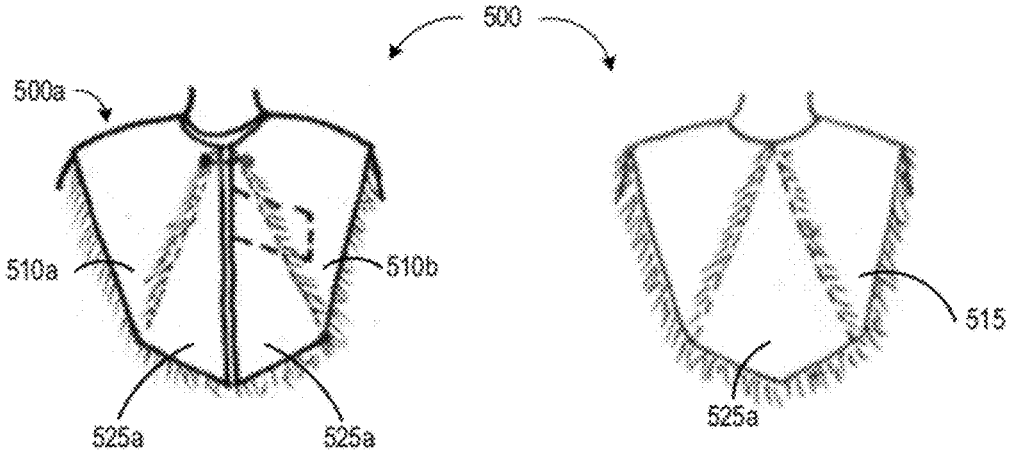
FIGS. 6A through 6E illustrate various methods for creating different looks for the article of FIG. 5.
Figure 6B:
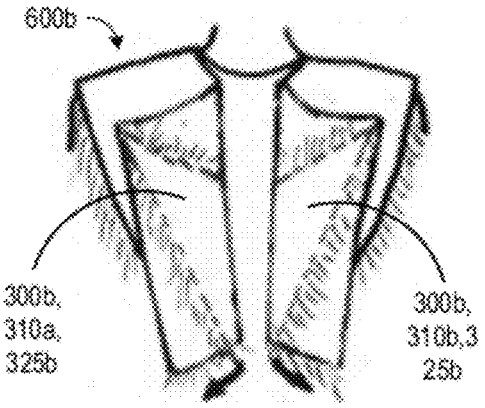
Figure 6C:
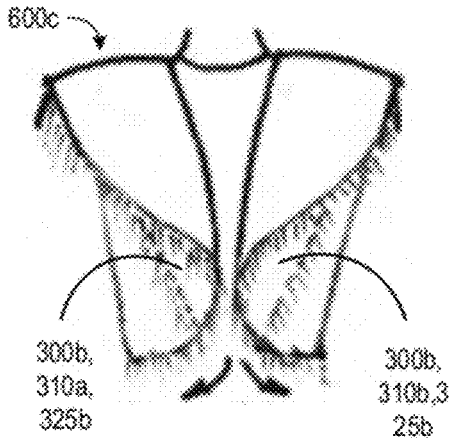
Figure 6D:
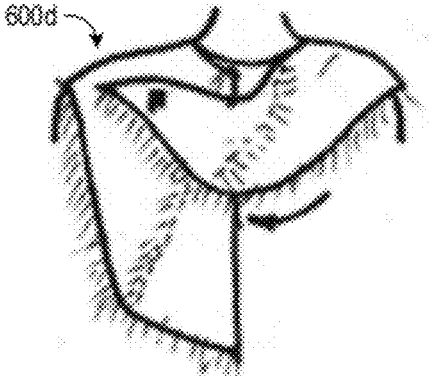
Figure 6E:
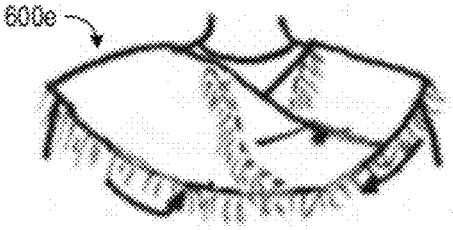

FIG. 1 illustrates an example article 100 having a first side 100*a* and second side 100*b* for accessorizing a person's shoulder, chest, and back. In some embodiments, the first side 100*a* consists of a first continuous sheet of material and the second side 100*b* consists of a second continuous sheet of material. In some embodiments, the first side 100*a* consists of a different look (e.g., different material and/or different decorative pattern) than the second side 100*b*. For example, FIGS. 3 and 5 illustrate example articles 300 and 500, respectively, where the first side 300*a*, 500*a* has a different look than the second side 300*b*, 500*b*, respectively.

Returning to FIG. 1, the diagonal marks on the second side 100*b* of article 100 are illustrated to distinguish the first side 100*a* from the second side 100*b* for illustrative purpose and are not intended to represent a pattern.

Each of the first side 100*a* and the second side 100*b* can consist of any material and any patterns, and, in some embodiments, can consist of multiple types of fabrics. For example, FIG. 5 illustrates an article 500 where the first side 500*a* and the second side 500*b* include decorative inserts 525*a, b*, respectively. For each side 500*a*, 500*b*, the decorative insert may comprise a different fabric and/or pattern than the remaining material. The first side and second side or parts thereof can consist of woven fabrics, leather, velveteen, ultra suede, vinyl, pleather, sequin, or any other fabric.

In some embodiments, the article 100 can be formed by attaching (e.g., sewing, gluing, taping, etc.) the first side 100*a* and second sheet 100*b* to create a reversible article 100 as shown in FIG. 2A.

In some embodiments, the first side 100*a* and/or the second side 100*b* or portions thereof can be made of a material heavier than silk fabrics or the like, which may help to give the article a more definite form and/or a heavier weight to reduce moving or slipping of the article 100 from its intended placement.

In some embodiments, the article 100 is stitched along its perimeter (or a portion thereof), which also may help to give the article a more definite shape.

In some embodiments, a decorative trim is attached to the outer perimeter of the article 100 (or a portion thereof), which may help to give the article 100 a more definite shape and/or more weight to help keep the article 100 in place. In some embodiments, a decorative trim is attached to the outer perimeter of the article 100 on the first side 100*a* and the second side 100*b*. For example, FIG. 5 illustrates an example article 500 having trim including fringes attached to the outer perimeter of the first side 500*a* and second side 500*b*. Also, as shown in FIG. 5, trim may also be added to the perimeter of decorative inserts 525*a, b*, (or portions thereof), which may help to the article to retain its shape when configured.

Returning to FIG. 1, the article 100 has a cut-out 105 (the interior area of the article having no material) for enabling the article 100 to be placed around the neck of a wearer and creating a first flap 110*a* and a second flap 110*b* to cover a portion of the wearer's chest area when the article is worn, as shown in FIG. 2A, for example. In some embodiments, the cut-out 105 is configured to form corners 116*a*, 116*b* at the top of the flaps 110*a*, 110*b*, respectively. In some embodiments, such as shown in FIG. 3, the cut-out 305 does not form corners at the top flaps 310*a*, 310*b* and the cut-out thereby defines a first curved cut-out and a second curved cut-out. This disclosure is not limited to any particular shape of cut-out so long as the cut-out enables an article to be placed around the neck of a wearer and creates two separate flaps that cover a portion of the wearer's chest. Those of ordinary skill in the art, with the benefit of the present disclosure, would know how to make an article having a cut-out to enable an article to be placed around the neck of a wear and create two separate flaps that cover a portion of the wearer's chest when the article is worn.

Returning to FIG. 1, the article 100 includes a back portion 115 that is dimensioned to cover a portion of the wearer's back when the article 100 is worn as shown in FIG. 2A, for example.

As shown in FIGS. 1 and 2A, the article 100 further includes a first shoulder portion 120*a* and a second shoulder portion 120*b* that are dimensioned to cover all or a portion of a wearer's shoulders when the article 100 is worn as shown in FIG. 2A, for example.

FIGS. 2A through 2G illustrates various methods for creating different looks for article 100 by arranging the first flap 110*a* and second flap 110*b* and, in some embodiments, using an attachment mechanism, such as decorative pins, to secure the flaps.

FIG. 2A1 illustrates a method of creating an example look 200*a*1 of the article 100. The look can be created by placing the article 100 on the wearer with the first side 100*a* visible as shown in FIG. 2A1. In some embodiments, a decorative attachment 215 may be added to enhance the look of article 100.

FIG. 2A2 illustrates a method of creating another example look 200*a*2 of the article 100. The look can be created by placing the article 100 on the wearer with the second side 100*b* visible as shown in FIG. 2A2.

Figure 2B:
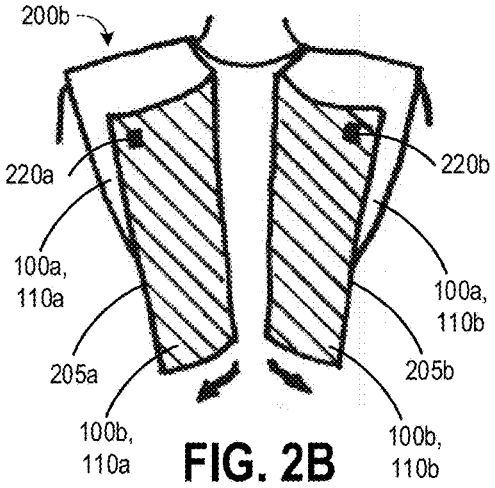

FIG. 2B illustrates a method of creating another example look 200*b* of the article 100. The look can be created by first placing the article 100 on the wearer with the first side 100*a* visible as shown in FIG. 2A1. The look then can be created by moving the inner perimeter 205*a, b* of the flaps 110*a, b*, respectively, over the flaps 110*a, b*, respectively, such that the flaps fold over themselves thereby revealing a portion of the second side 100*b* of flaps 110*a, b* over the first side 100*a* of the flaps as shown in FIG. 2B. In some embodiments, the flaps 110*a, b* may be secured and/or further enhanced as shown in FIG. 2B, for example, with attachment mechanisms 220*a, b* such as a decorative pins.

Figure 2C:
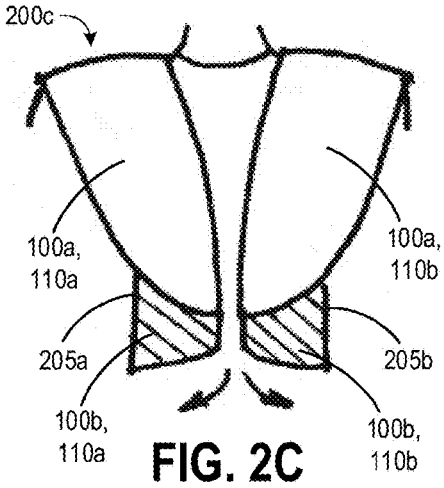

FIG. 2C illustrates a method of creating another example look 200*c* of the article 100. The look can be created by first placing the article 100 on the wearer with the first side 100*a* visible as shown in FIG. 2A1. The look then can be created by moving the inner perimeter 205*a,b* of the flaps 110*a, b*, respectively, under the flaps 110*a, b*, respectively, such that the flaps fold under themselves thereby revealing a portion of the second side 100*b* of flaps 110*a, b* under the first side 100*a* of the flaps as shown in FIG. 2C.

Figure 2D:
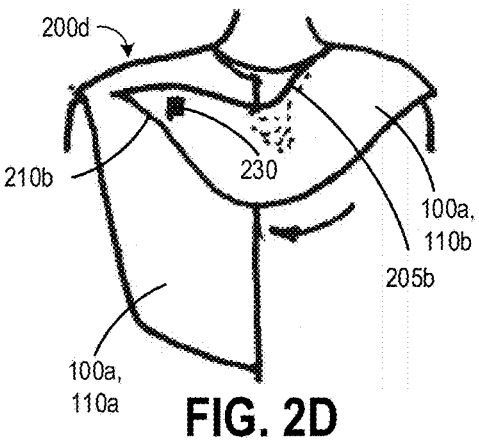

FIG. 2D illustrates a method of creating another example look 200*d* of the article 100. The look can be created by first placing the article 100 on the wearer with the first side 100*a* visible as shown in FIG. 2A1. The look then can be created by tucking the corner 116*b* of the flap 110*b* under the flap 110*b* and moving the bottom perimeter 210*b* of flap 110*b* up and over the other flap 110*a* as shown in FIG. 2D and securing the flap 110*b* over the other flap 110*a* with an attachment mechanisms 230, such as a decorative pin, for example. In some embodiments, the flap 110*b* can be secured to flap 110*a* in an upper area of flap 110*a* or shoulder portion 120*a* to create a half-cowl look as shown in FIG. 2D.

Figure 2E:
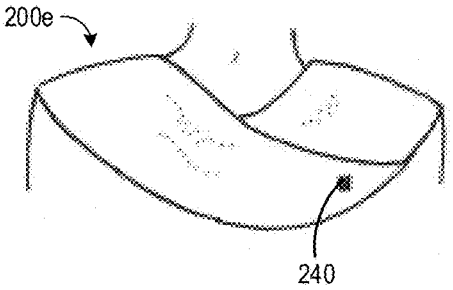

FIG. 2E illustrates a method of creating another example look 200*e* of the article 100. The look can be created by first placing the article 100 on the wearer with the first side 100*a* visible as shown in FIG. 2A1. The look then can be created by tucking the corner 116*a, b* of the flaps 110*a, b*, respectively, under the flaps and then crossing the flaps and tucking the ends of each flap under the other flap as shown in FIG. 2E. The flaps can be secured to hold the configuration with an attachment mechanism 240, such as a decorative pin, for example, as shown in FIG. 2E.

Figure 2F:
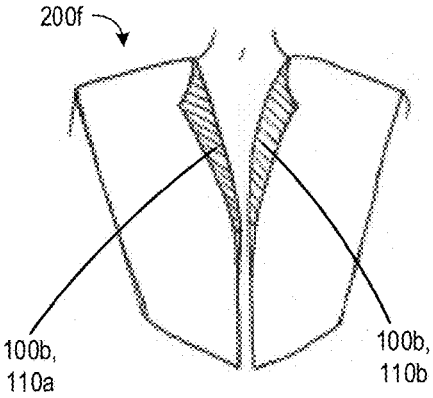

FIG. 2F illustrates a method of creating another example look 200*f* of the article 100. The look can be created by first placing the article 100 on the wearer with the first side 100*a* visible as shown in FIG. 2A1. The look 200*f* then can be created in a manner similar to the manner of creating the look 200*b* of FIG. 2B. The look 200*f* can be created by moving a top portion of the inner perimeter 205*a, b* of the flaps 110*a, b*, respectively, over the flaps 110*a, b*, respectively, thereby revealing a portion of the second side 100*b* of flaps 110*a, b* over the first side 100*a* of the flaps as shown in FIG. 2F.

Figure 2G:
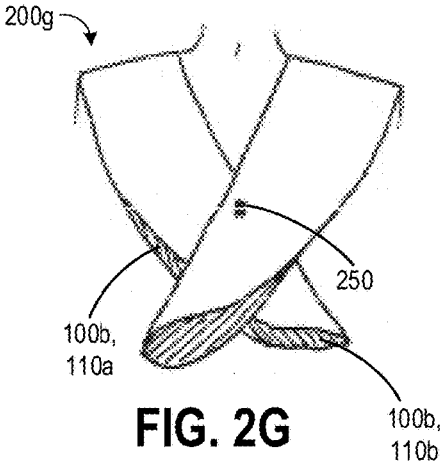

FIG. 2G illustrates a method of creating another example look 200*g* of the article 100. The look can be created by first placing the article 100 on the wearer with the first side 100*a* visible as shown in FIG. 2A1. The look 200*g* then can be created in a manner similar to the manner of creating the look 200*c* of FIG. 2C. The look 200*g* can be created by moving the inner perimeter 205*a,b* of the flaps 110*a, b*, respectively, under the flaps 110*a, b*, respectively, such that the flaps fold under themselves thereby revealing a portion of the second side 100*b* of flaps 110*a, b* under the first side 100*a* of the flaps as shown in FIG. 2G and then criss-crossing the flaps as shown in FIG. 2G. In some embodiments, the flaps can be secured to hold the criss-cross configuration with an attachment mechanism 250, such as a decorative pin, for example, as shown in FIG. 2G.

Figure 2H:
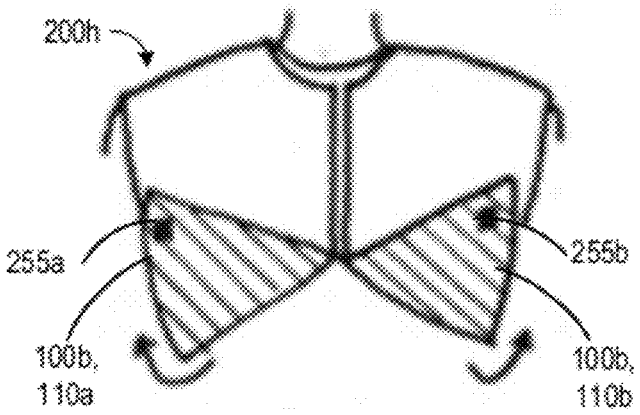

FIG. 2H illustrates a method of creating another example look 200*h* of the article 100. The look can be created by first placing the article 100 on the wearer with the first side 100*a* visible as shown in FIG. 2A1. The look then can be created by moving the corners 118 *a, b* of the flaps 110*a, b*, respectively, up and over the flaps 110*a, b*, respectively, to toward the outer perimeter 207*a, b* of the flaps 110*a, b*, respective, as shown in FIG. 2G, such that the flaps fold over themselves thereby revealing a portion of the second side 100*b* of flaps 110*a, b* over the first side 100*a* of the flaps as shown in FIG. 2G. The corners 118 *a, b* then can be secured with attachment mechanisms 255*a, b* such as decorative pins, as shown in FIG. 2H.

Additional looks may be created by first placing the article 100 on the wearer with the second side 100*b* visible as shown in FIG. 2A2. and repeating the methods discussed above.

Numerous other methods exist for creating different looks for article 100 by adjusting the first flap 110*a* and second flap 110*b* and, in some embodiments, using attachment means such as decorative pins to secure the flaps.

Articles for accessorizing a person's shoulder, chest, and back according to this disclosure can come in a variety of shapes, sizes, and designs.

For example, FIG. 3 illustrates another example article 300 having a first side 300*a* and second side 300*b* for accessorizing a person's shoulder, chest, and back. The article 300 has a cut-out 305 for enabling the article 300 to be placed around the neck of a wearer and creating a first flap 310*a* and a second flap 310*b* to cover a portion of the wearer's chest area when the article is worn as shown in FIG. 4A, for example.

Figure 4A:
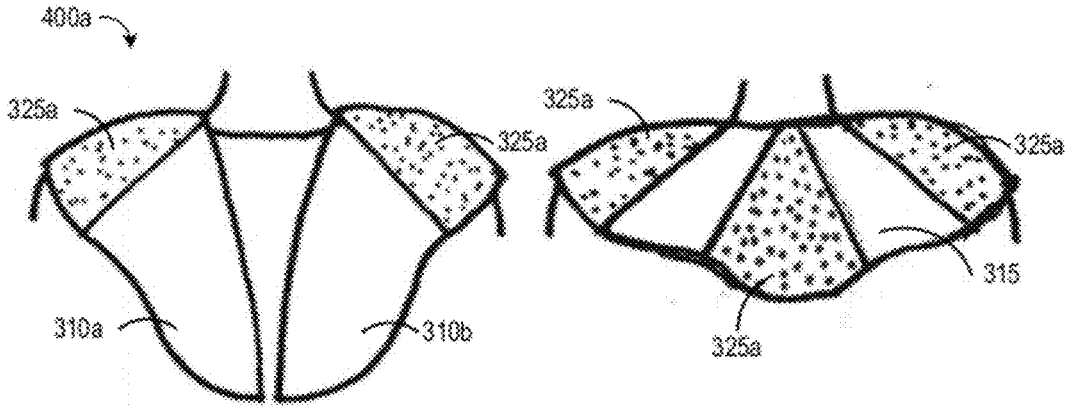
FIGS. 4A through 4E illustrate various methods for creating different looks for the article of FIG. 3.
Figure 4B:
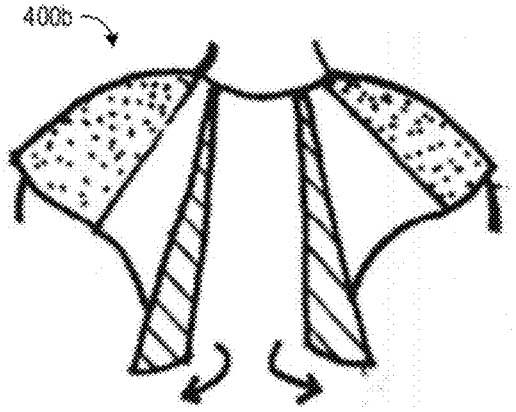
Figure 4C:
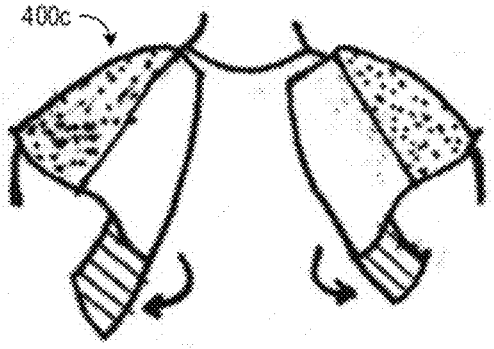
Figure 4D:
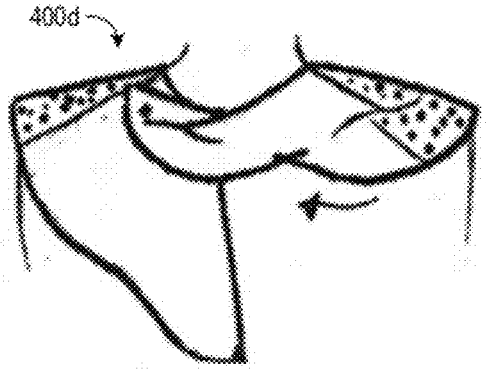

Returning to FIG. 3, the article 300 includes a back portion 315 that is dimensioned to cover a portion of the wearer's back when the article 300 is worn as shown in FIG. 4A.

As shown in FIGS. 3 and 4A, the article 300 further includes a first shoulder portion 320*a* and a second shoulder portion 320*b* that are dimensioned to cover all or a portion of the wearer's shoulders.

As can be seen in FIGS. 1 and 3, the cut-out 105 of FIG. 1 has a different shape than the cut-out 305 of FIG. 3 thereby varying the shape of the article when placed on the wearer, as can be seen in FIGS. 2A and 4A.

Furthermore, the dimensions and shape of the back portion 115 and flaps 110*a, b* of FIG. 1 can be different than the dimensions and shape of the back portion 315 and flaps 310*a, b* of FIG. 3 to achieve a different look of the article when placed on the wearer, as can be seen in FIGS. 2A and 4A.

Still further, the article 300 of FIG. 3 includes decorative inserts 325*a, b* on the first side 300*a* and second side 300*b*, respectively, to further enhance the appearance of the article 300. For example, FIG. 3 illustrates decorative inserts 325*a* on the first side 300*a* of article 300 in the shoulder portions 320*a, b* and back portion 315. When the article is worn, these decorative inserts 325*a* serve to enhance the shoulder portions 320*a, b*, and back portion 315 as shown in FIG. 4.

In some embodiments, the decorative inserts can comprise a different material and/or different pattern than the remainder of the material on a side.

In some embodiments, the decorative inserts (e.g., 325*a*) on a side (e.g., 300*a*) are layered on top of a main material (e.g., 327) on the side such that the regions comprising the decorative inserts have two layers of fabric (i.e., the decorative insert and the main material).

FIGS. 4A through 4D illustrates various methods for creating different looks 400*a* through 400*d*, respectively, for article 300 by arranging the first flap 310*a* and second flap 310*b* and, in some implementation, using attachment means such as decorative pins to secure the flaps. The different looks 400*a* through 400*d* illustrated in FIGS. 4A through 4D can be achieved in a similar manner as described with respect to FIGS. 2A1, and 2B through 2D, respectively.

As discussed above, additional looks may be created by placing the article 300 on the wearer with the second side 300*b* visible and repeating the methods discussed above.

Numerous other methods, including the methods discussed with respect to FIGS. 2E through 2H, exist for creating different looks for article 300 by arranging the first flap 310*a* and second flap 310*b* and, in some embodiments, using attachment means such as decorative pins to secure the flaps.

Figure 4E:
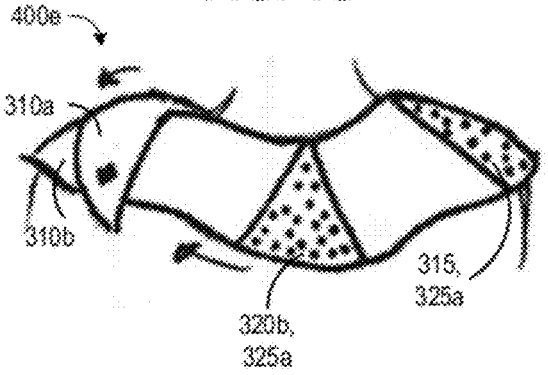

FIG. 4E illustrates a method of creating another example look 400*e* of the article 300. The look is created by rotating the article 300 such that the shoulder portion 320*b* covers a portion of the chest area and a portion of the back portion 315 (e.g., the decorative insert 325*a* of the back portion 315) covers a portion of the shoulder. The flaps 310*a,b* are then placed over the shoulder as shown in FIG. 4E.

FIG. 5 illustrates another example article 500 having a first side 500*a* and second side 500*b* for accessorizing a person's shoulder, chest, and back. The article 500 of FIG. 5 is similar to the article 100 of FIG. 1. However, FIG. 5 illustrates decorative inserts 525*a* on the first side 500*a* of article 500 in the flaps 510*a, b* and back portion 515. FIG. 5 also illustrates decorative inserts 525*b* on the second side 500*b* of article 500 in the flaps 510*a, b* and back portion 515.

As discussed above, the decorative inserts can comprise a different material and/or different pattern than the remainder of the material on a side. In some embodiments, the decorative inserts (e.g., 525*a*) on a side (e.g., 500*a*) are layered on top of a main material (e.g., 527*a*) on the side such that the regions comprising the decorative inserts have two layers of fabric (i.e., the decorative insert and the main material).

The article 500 also includes fringes 530. In some embodiment, the fringes can be replaced with feathers, beads, are another other decorative element. When the article is worn in different looks, these decorative inserts 525*a,b* and fringes 530 serve to enhance the article as shown in FIGS. 6A through 6E.

As shown in FIGS. 6A through 6E, when different looks are created by arranging the first flap 510*a* and second flap 510*b*, the decorative inserts 525*a, b* further enhance the appearance of the article. The different looks 600*a* through 600*e* illustrated in FIGS. 6A through 6E can be achieved in a similar manner as described with respect to FIGS. 2A1, 2B through 2E, respectively, above.

As discussed above, additional looks may be created by placing the article 500 on the wearer with the second side 500*b* visible and repeating the methods discussed above. Numerous other methods, including the methods discussed with respect to FIGS. 2F through 2H and FIG. 4E, exist for creating different looks for article 500 by adjusting the first flap 510*a* and second flap 510*b* and, in some implementation, using attachments such as decorative pins to secure the flaps.

In some embodiments, the article may include a pocket 117 to store items such as money, card(s) (e.g., credit cards, driver's license, hotel room card, business cards, etc.), or thin electronic devices. In some embodiments, the pocket 117 is hidden, for example, between the seams of the article. In some embodiments, the pocket may be attached as an overlay pocket with trimmings to the article. In some embodiments, the pocket 117 may be detachable.

Figure 7:
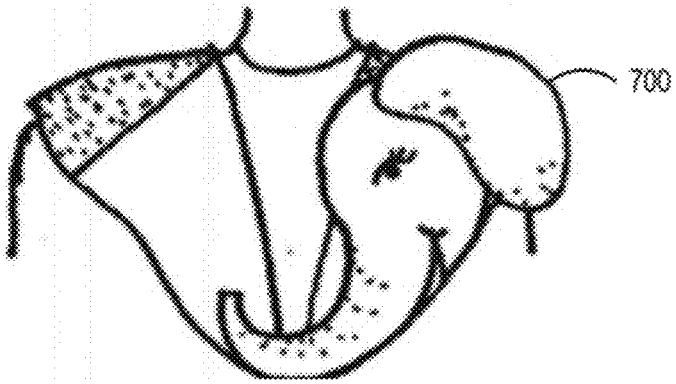
FIG. 7 illustrates the article of FIG. 4A having a decorative article in the form of an animal's heads attached thereto.

In some embodiments, the article may be further enhanced by attaching additional adornments to the article including decorative attachments having abstract designs or shapes, attachment having the shape of an animal's heads (as shown in FIG. 7, for example), feathers, stones, jewelry pieces, and pins. In some implementations, the adornments can be detachable. An adornment may be attached to an article in a number of ways, including but not limit to, by using pins, snaps, hooks, zippers, buttons, magnets, or VELCRO® (a type of hook-and-loop fastener), for example.

Figure 8:
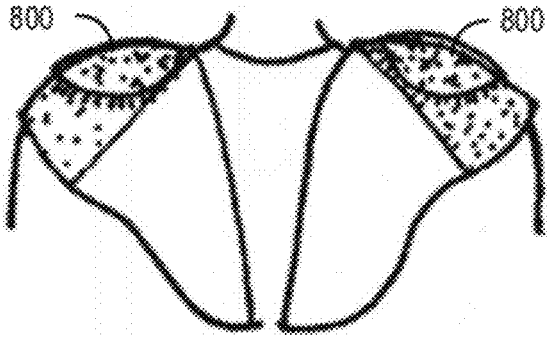
FIG. 8 illustrates the article of FIG. 4A having shoulder pads attached thereto.

In some embodiments, shoulder pads 800 can be attached on the shoulder portion of the article as shown in FIG. 8. The shoulder pads 800 may be attached by any means including, but not limited to, by using pins, snaps, hooks, zippers, buttons, magnets, or Velcro, for example. In some embodiments, the shoulder pads 800 have designs on both sides for reversibility. In some embodiments, the shoulder pads 800 may be attached to on the shoulder portion of any article including but not limited to shirts, jackets, and scarves, for example.

Reference throughout this specification to "an embodiment" or words of similar import means that a particular described feature, structure, or characteristic is included in at least one embodiment of the present invention. Thus, the phrase "in an embodiment" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A method of accessorizing a person's shoulders, chest, and back, the method comprising:

providing an article, the article comprising:

a continuous first sheet of material made from a material selected from the group consisting of: woven fabric, leather, velveteen, ultra-suede, vinyl, and pleather; wherein the first sheet of material has a first flap, a second flap, a first shoulder portion, a second shoulder portion, and a back portion to collectively form the continuous first sheet of material, wherein the first sheet of material includes a first curved cut-out between the first flap and the second flap, wherein the first curved cut-out exists in the continuous first sheet of material when the first sheet of material is laid flat and fully extended;

a continuous second sheet of material made from a material selected from the group consisting of: woven fabric, leather, velveteen, ultra-suede, vinyl, and pleather; wherein the second sheet of material has a first flap, a second flap, a first shoulder portion, a second shoulder portion, and a back portion to collectively form the continuous second sheet of material, wherein the second sheet of material includes a second curved cut-out between the first flap and the second flap of the second sheet of material, wherein the second curved cut-out exists in the continuous second sheet of material when the second sheet of material is laid flat and fully extended;

wherein the first sheet of material and the second sheet of material each has a respective outer perimeter and are sewn together along said outer perimeters to form a two-sided first flap, a two-sided second flap, a two-sided first shoulder portion, a two-sided second shoulder portion, and a two-sided back portion;

wherein the first curved cut-out and the second curved cut-out between the first flap and the second flap of each of the first sheet of material and the second sheet of material, respectively, are configured to be placed around a neck of the person and the two-sided first flap and the two-sided second flap are configured to cover a portion of the chest when the first curved cut-out and the second curved cut-out between the first flap and the second flap of each of the first sheet of material and the second sheet of material is placed around the neck, the two-sided first shoulder portion and the two-sided second shoulder portion are configured to cover at least a portion of a first shoulder and a second shoulder of the person's shoulders when the first curved cut-out and the second curved cut-out between the first flap and the second flap of each of the first sheet of material and the second sheet of material, respectively, are placed around the neck, and the two-sided back portion is configured to cover a portion of the person's back when the first curved cut-out and the second curved cut-out between the first flap and the second flap of each of the first sheet of material and the second sheet of material, respectively, are placed around the wearer's neck; and wherein the first sheet of material has a first pattern and the second sheet of material has a second pattern, wherein the first pattern and the second pattern are different from one another, wherein the first sheet of material is configured to be worn as an outer layer; and wherein the second sheet of material is configured to be worn as an outer layer; the method further comprising:

placing the first curved cut-out and the second curved cut-out between the first flap and the second flap of the first sheet of material and the second sheet of material, respectively, around the person's neck such that the two-sided first flap and the two-sided second flap cover a portion of the chest, the two-sided first shoulder portion and the two-sided second shoulder portion cover at least a portion of the first shoulder and the second shoulder, and the two-sided back portion covers a portion of the person's back.

2. The method of claim 1, further comprising:

arranging the two-sided first flap and the two-sided second flap to thereby create a new appearance.

3. The method of claim 1, further comprising:

folding a first portion of the two-sided first flap over a second portion of the two-sided first flap to thereby reveal a portion of one side of the first flap over the other side of the first flap; and folding a first portion of the two-sided second flap over a second portion of the two-sided second flap to thereby reveal a portion of one side of the second flap over the other side of the second flap.

4. The method of claim 1, further comprising:

folding a first portion of the two-sided first flap under a second portion of the two-sided first flap to thereby reveal a portion of one side of the first flap under the other side of the first flap; and folding a first portion of the two-sided second flap under a second portion of the two-sided second flap to thereby reveal a portion of one side of the second flap under the other side of the second flap.

5. The method of claim 4, further comprising:

criss-crossing the two-sided first flap and the two-sided second flap.

6. The method of claim 1, further comprising:

folding an upper portion of the two-sided first flap over another portion of the two-sided first flap to thereby reveal a portion of one side of the first flap over the other side of the first flap; and folding an upper portion of the two-sided second flap over another portion of the two-sided second flap to thereby reveal a portion of one side of the second flap over the other side of the second flap.

7. The method of claim 1, further comprising:

selecting one of the two-sided flaps and tucking a top corner of the selected two-sided flap under a remainder of the selected two-sided flap, and moving a bottom perimeter of the selected two-sided flap up and over the other two-sided flap so that the bottom perimeter is concealed from view from an exterior perspective of the article.

8. The method of claim 1, further comprising:

tucking a top corner of each of the two-sided first flap and the two-sided second flap under a remainder of the flaps, respectively, and subsequently crossing the flaps and tucking a respective end of each flap under the other flap so that the ends are concealed from view from an exterior perspective of the article.

9. The method of claim 1, further comprising:

providing a pocket on either of the first flap or the second flap; and storing an item in the pocket.

10. The method of claim 9, further comprising:

hiding the pocket between the first sheet of material and the second sheet of material, wherein the step of storing the item in the pocket comprises storing the item between the first sheet of material and the second sheet of material.

11. A method of accessorizing a person's shoulders, chest, and back, the method comprising:

providing an article, the article comprising:

a continuous first sheet of material made from a material selected from the group consisting of: woven fabric, leather, velveteen, ultra-suede, vinyl, and pleather; wherein the first sheet of material has a first flap, a second flap, a first shoulder portion, a second shoulder portion, and a back portion to collectively form the continuous first sheet of material, wherein the first sheet of material includes a first curved cut-out between the first flap and the second flap, wherein the first curved cut-out exists in the continuous first sheet of material when the first sheet of material is laid flat and fully extended;

a continuous second sheet of material made from a material selected from the group consisting of: woven fabric, leather, velveteen, ultra-suede, vinyl, and pleather; wherein the second sheet of material has a first flap, a second flap, a first shoulder portion, a second shoulder portion, and a back portion to collectively form the continuous second sheet of material, wherein the second sheet of material includes a second curved cut-out between the first flap and the second flap of the second sheet of material, wherein the second curved cut-out exists in the continuous second sheet of material when the second sheet of material is laid flat and fully extended;

wherein the first sheet of material and the second sheet of material each has a respective outer perimeter and are sewn together along said outer perimeters to form a two-sided first flap, a two-sided second flap, a two-sided first shoulder portion, a two-sided second shoulder portion, and a two-sided back portion;

wherein the first curved cut-out and the second curved cut-out between the first flap and the second flap of each of the first sheet of material and the second sheet of material, respectively, are configured to be placed around a neck of the person and the two-sided first flap and the two-sided second flap are configured to cover a portion of the chest when the first curved cut-out and the second curved cut-out between the first flap and the second flap of each of the first sheet of material and the second sheet of material is placed around the neck, the two-sided first shoulder portion and the two-sided second shoulder portion are configured to cover at least a portion of a first shoulder and a second shoulder of the person's shoulders when the first curved cut-out and the second curved cut-out between the first flap and the second flap of each of the first sheet of material and the second sheet of material, respectively, are placed around the neck, and the two-sided back portion is configured to cover a portion of the person's back when the first curved cut-out and the second curved cut-out between the first flap and the second flap of each of the first sheet of material and the second sheet of material, respectively, are placed around the wearer's neck; and wherein the first sheet of material has a first pattern and the second sheet of material has a second pattern, wherein the first pattern and the second pattern are different from one another, wherein the first sheet of material is configured to be worn as an outer layer; and wherein the second sheet of material is configured to be worn as an outer layer; the method further comprising:

placing the first curved cut-out and the second curved cut-out between the first flap and the second flap of each of the first sheet of material and the second sheet of material around the person's neck such that the two-sided first flap and the two-sided second flap cover a portion of a first shoulder of the person's shoulders, the two-sided first shoulder portion covers a portion of the chest, and the two-sided second shoulder portion covers at least a portion of the back, and the two-sided back portion covers a portion of a second shoulder of the person's shoulders.

* * * * *